US005382881A

United States Patent [19]

Farkas et al.

[11] Patent Number: 5,382,881

[45] Date of Patent: Jan. 17, 1995

[54] BALLAST STABILIZATION CIRCUITRY FOR ELIMINATING MODING OR OSCILLATION OF THE CURRENT ENVELOPE IN GAS DISCHARGE LAMPS AND METHOD OF OPERATING

[75] Inventors: Thomas Farkas; Sreeraman Venkitasubrahmanian, both of Ossining, N.Y.

[73] Assignee: North American Philips Corporation, New York, N.Y.

[21] Appl. No.: 997,989

[22] Filed: Dec. 28, 1992

[51] Int. Cl.[6] ..... G05F 1/00

[52] U.S. Cl. ..... 315/307; 315/209 R; 315/224; 315/DIG. 5; 315/DIG. 7

[58] Field of Search ..... 315/307, 209 R, 224, 315/DIG. 5, DIG. 4, DIG. 7

[56] References Cited

U.S. PATENT DOCUMENTS 4,346,331 8/1982 Hoge ..... 315/307 X
4,952,849 8/1990 Fellows et al. ..... 315/307
5,041,763 8/1991 Sullivan et al. ..... 315/307 X
5,089,751 2/1992 Wong et al. ..... 315/307 X

FOREIGN PATENT DOCUMENTS 0483082 4/1992 European Pat. Off. .

*Primary Examiner*—Robert J. Pascal
*Assistant Examiner*—Haissa Philogene
*Attorney, Agent, or Firm*—Paul R. Miller

[57] ABSTRACT

A ballast stabilization arrangement is provided for minimizing or eliminating lamp current oscillation, or moding, of gas discharge lamps, such as fluorescent lamps, and a method for carrying out this arrangement is described. This is carried out by adding a frequency response zero to the current circuitry in a ballast. An example of this circuitry includes a feedback network where a sensed lamp current signal is compared with a reference signal by an error amplifier having a resistance placed in series with its feedback capacitance to implement the zero in the frequency response of the control circuit.

10 Claims, 5 Drawing Sheets

BALLAST STABILIZATION CIRCUITRY FOR ELIMINATING MODING OR OSCILLATION OF THE CURRENT ENVELOPE IN GAS DISCHARGE LAMPS AND METHOD OF OPERATING

The present invention seeks to eliminate the moding, or oscillation of the lamp current envelope, resulting from destabilizing effects of a lamp's dynamics on the current control feedback loop in a gas discharge lamp, such as a variable frequency electronic ballast. In particular, it has been found that by adding a frequency response zero in the feedback loop by a resistive scheme, undesirable oscillation or variation of the peak arc current in a gas discharge lamp is eliminated.

BACKGROUND OF THE INVENTION

Various standard electronic ballasts used in fluorescent lighting result in undesirable oscillation of the lamp current envelope when dimming to low levels of lamp current. Such oscillation of the lamp current envelope results in poor crest factor, and may cause flicker of the light and in some instances extinction of the arc.

In such standard lamp current control techniques of the prior art, current feedback has been utilized. The oscillation of the lamp current, i.e. moding or modulation of the amplitude, particularly affects narrow-tube lamps, especially at low current levels.

Various of the prior techniques used to alleviate moding are incomplete. For example, applicable current and frequency ranges are limited. Other potential prior solutions have contemplated fairly complex schemes. Such complex systems, however, involve significantly increased numbers of components and costs. For example, prior attempts for solving moding have involved about ten times the number of components at costs ranging from 10 to 20 times that proposed by the present invention.

Typical standard commercial fluorescent ballasts may be seen by reference to U.S. Pat. Nos. 4,952,849 and 5,089,751, both of which are assigned to the same assignee as the present application. Such prior techniques involve control circuitry that senses the lamp current, applies a R-C lowpass filter to give a low frequency roll-off pole, compares the signal to a reference, and adjusts the frequency of a half-bridge driver. If this type of electronic ballast is operated on a pair of series-connected quad tube fluorescent lamps, the arrangement results in lamp current moding which destabilizes the lamp current envelope at low current levels.

For purposes of this application a frequency response zero is as defined at page 1030, and a pole is as defined at page 660 of the IEEE Standard Dictionary of Electrical and Electronic Terms, 3rd Ed, 1984.

SUMMARY OF THE INVENTION

The presently claimed invention enables the elimination of lamp current oscillation, or moding, during current or power feedback control of gas discharge lamps, such as fluorescent lamps. In particular, this significant benefit of the present invention occurs from the addition of a zero in the feedback loop of the control circuitry. This zero may be implemented by adding resistance in series with a feedback or low pass filtering capacitance in the feedback loop to virtually eliminate such oscillation of the lamp current envelope.

It has been further found that the placing of an additional capacitor in parallel with the series R-C arrangement adds a high-frequency pole to ensure sufficient filtering by continued loop gain roll-off at higher frequencies.

The addition of the resistance value in series with the filter capacitor, and possibly a further parallel capacitance, modifies standard commercial fluorescent dimming ballasts where the control circuitry senses lamp current or power, rectifies and filters the signal with an R-C filter having a low frequency roll-off pole, compares the signal with a reference, and adjusts the frequency or other control parameter of a half-bridge driver. The resistance is selected so that the R-C product adds a zero to the frequency response of the feedback loop, so that the unity gain crossover occurs with sufficient phase margin.

The thermodynamic properties of fluorescent lamps result in a pole on the order of a few hundred Hertz with variations also depending on the operating point and ambient temperature. Since the lamp current control loop implemented by an error amplifier needs a large DC gain and must roll-off well before the switching frequency, such an error amplifier circuit is generally designed with a high gain and a low-frequency roll-off pole on the order of a few Hertz. In the instance of a steep static current versus frequency characteristic, which is generally accompanied by a lower frequency lamp pole, the lamp pole is likely to occur below the unity gain crossover (UGC) frequency of the loop transmission. If the lamp pole is at the UGC frequency, the phase margin of the control loop is about 45°, but as the lamp pole gets substantially lower, the phase margin deteriorates resulting in oscillation.

Thus, the solution to the lamp current moding of the type occurring in standard commercial fluorescent ballasts is the use of lead compensation (a zero-pole pair). The zero is placed in the error amplifier circuit or low-pass filter circuit of the control loop to approximately cancel the lamp pole and allow a single-pole roll-off, which leads to a good phase margin. The additional pole of the lead compensation is placed at a much higher frequency to ensure sufficiently low gain at the switching frequency.

BRIEF DESCRIPTION OF THE DRAWING FIGURES

The present invention will now be described in terms of the following drawing figures in which:

FIG. 1 shows by circuit diagram a solution to the moding or oscillation of the lamp current according to the present invention;

FIG. 2*a* shows in graphic form an oscillation of the voltage input to the voltage control oscillator (VCO), and FIG. 2*b* shows the lamp current that would result from such an oscillation in the VCO voltage;

FIG. 3*a* shows schematically the moding or oscillation of the current in a lamp according to the prior art, while FIG. 3*b* shows schematically the elimination of this oscillation according to the present invention;

DESCRIPTION OF THE INVENTION

Figure 1:
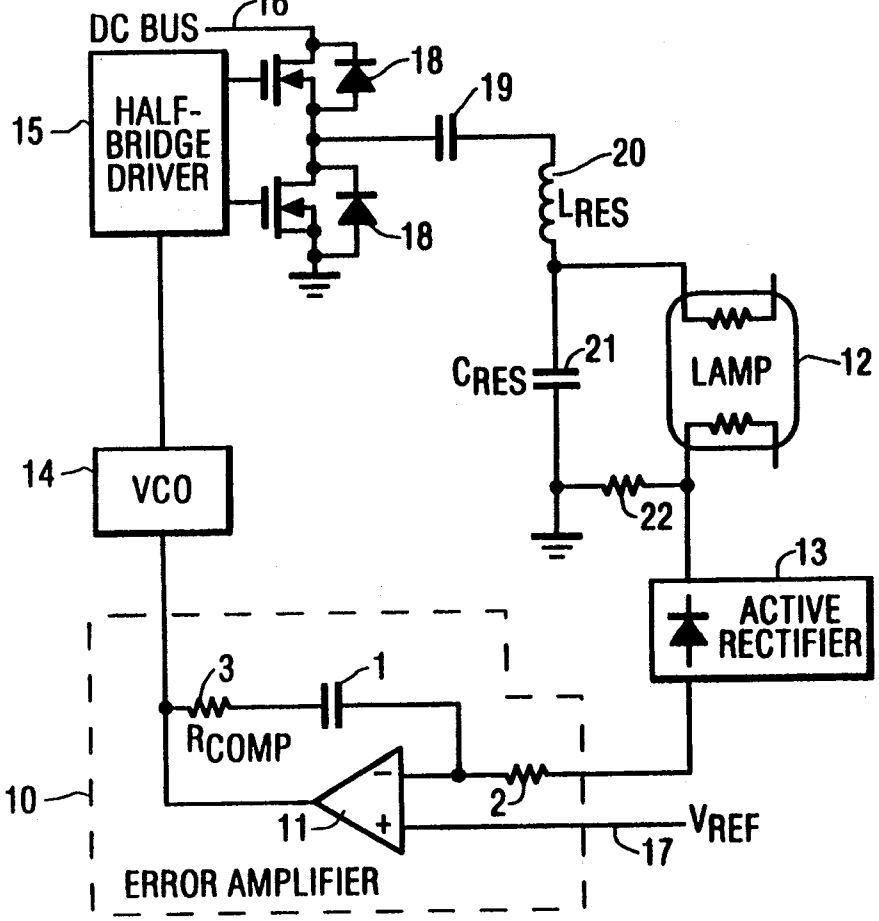

The solution to oscillation or moding in fluorescent lamp circuits may be seen from FIG. 1 in which the current control loop of a variable frequency electronic fluorescent ballast is illustrated. In this circuitry, the lamp 12 is fed with current from a DC bus 16 through transistors 18 to a resonant tank circuit consisting of the lamp, inductor $L_{res}$ 20, capacitor $C_{res}$ 21, and DC blocking capacitor 19. The sensed lamp current signal is directed through a control circuit having a rectifier 13, an error amplifier stage 10, a voltage control oscillator 14 and a half-bridge driver 15. This control circuit operates by sensing the lamp current and comparing the resulting signal with a reference voltage $V_{ref}$ introduced in line 17 to an error amplifier 11.

If the filtered and rectified sensed lamp current signal is higher than the reference voltage $V_{ref}$, the error amplifier will decrease the VCO input voltage to increase the frequency of the variable frequency half-bridge driver 15. In the control circuitry of FIG. 1, the feedback capacitor 1 with the resistance 2 gives a single-pole roll-off of the amplifier gain.

However, the lamp 12 itself introduces an additional pole. The lamp pole is the frequency where the change in arc current is so fast that the lamp resistance can't keep up. More specifically, this is a pole in the frequency response of the lamp's incremental resistance to fluctuations of the arc current. The phase delay of the lamp manifests itself as a delay in the change in the impedance.

Figure 2A:
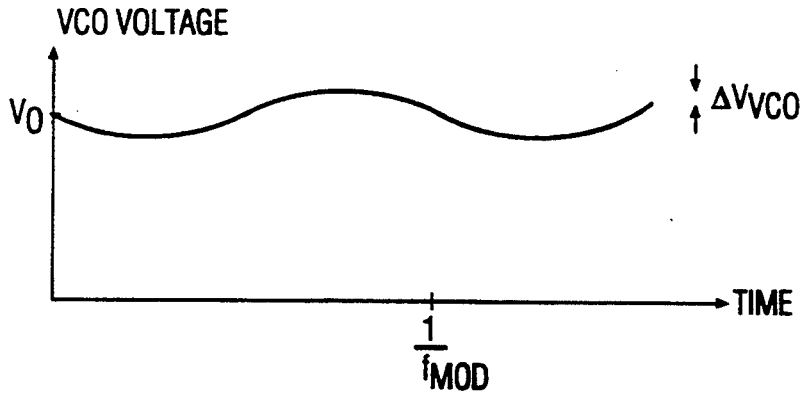
Figure 2B:
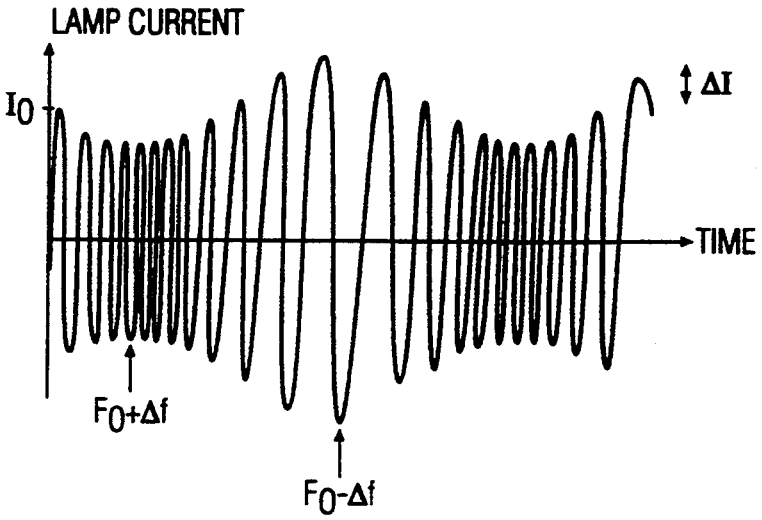

The resulting poor phase margin causes an oscillation in the feedback loop, which exhibits itself as a variation of the VCO input voltage, as seen in FIG. 2*a*, and an amplitude modulation and/or frequency modulation of the lamp current, as seen in FIG. 2*b*. The lamp current control loop circuitry needs a large DC gain and must roll-off well before the switching frequency. Accordingly, the error amplifier stage 10 is generally designed with a high gain and a low frequency roll-off pole of the order of a few Hertz.

The solution to the oscillation or moding occurring in FIG. 2, is to add a zero to the frequency response of the feedback circuit implemented by a resistance value, such as the resistor 3 in FIG. 1. Effectively, this zero serves to cancel the undesirable phase shift due to the pole introduced by the lamp dynamics in the frequency response of the feedback loop. The zero frequency is chosen such that the frequency response of the loop transmission has sufficient phase margin. A typical value for the phase margin may be 45 degrees. In FIG. 1, for example, the zero frequency is determined by resistance 3 and capacitance 1 from the relation $\frac{1}{2}\pi RC$. The value of the resistor 3 would depend on the lamp 12 and the values of the components in the resonant tank, In theory, the problem of oscillation or moding can occur with any gas discharge lamp. In practice, the lamp 12 may be a narrow tube fluorescent lamp which leads to the most difficult problem of oscillation of the current. The problem also occurs in other type fluorescent lamps, such as dual-type fluorescent lamps, as well as quad-type fluorescent lamps.

Figure 5:
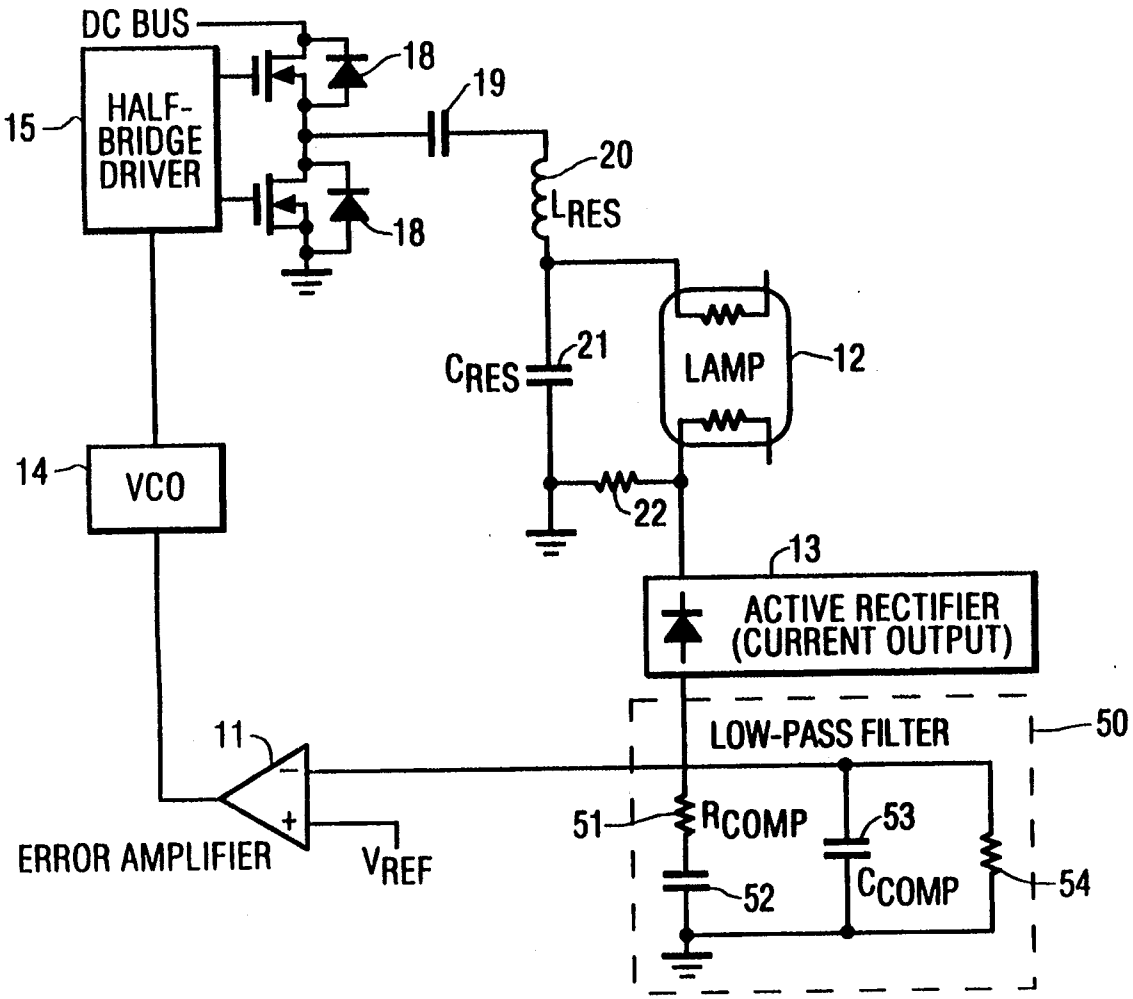
FIG. 5 shows another embodiment of the present invention.

FIG. 5 has a low pass filter placed at the output of the lamp current rectifier 13, rather than being incorporated in the error amplifier as in FIG. 1. As an example, the circuit in FIG. 5, shows another embodiment that may be formed for driving a pair of 26 watt quad tube lamps. A lamp current of about 38 mA rms operating on a ballast as in U.S. Pat. Nos. 4,952,849 and 5,089,751 causes severe moding with a peak amplitude around 130 mA and a crest factor of 3.4. An intermediate oscillation frequency, or moding frequency, of about 600 Hz is observed. Zero compensation is implemented by using a 330 ohm resistor for the resistance 51 in series with a capacitance 52 of 1 microfarad ($\mu$F).

The value of the resistance 51 is selected to add a zero to the frequency response of the feedback loop at a value of around 500 Hz. The moding of the lamp current is completely eliminated by this solution, such as seen by way of FIG. 3*b*.

Figure 3A:
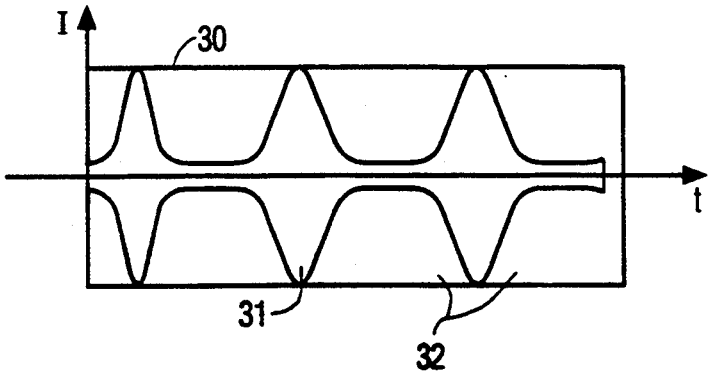
FIG. 3a PRIOR ART
Figure 3B:
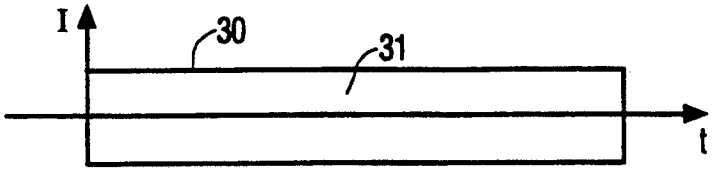

In FIG. *a*, without the use of the resistance 51 in the feedback circuitry, an oscillation 31 may be seen in the envelope of the current wave form. This oscillation causes a variation in the light intensity which is sometimes visible, i.e. flickering. On the other hand, with the addition of the resistor 51 in the feedback circuit, the amplitude of the high frequency current waveform 31 of FIG. 3*b* is constant, leading to a light output without any flickering or oscillation.

Figure 4:
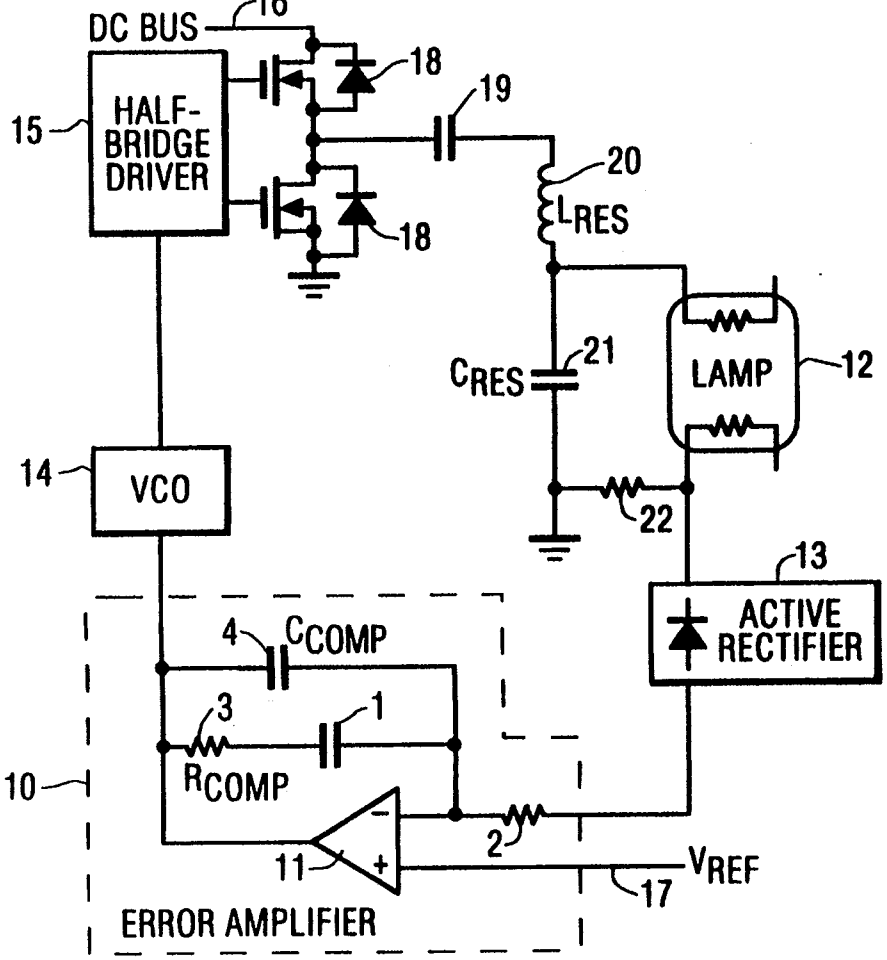
FIG. 4 shows a further embodiment of the present invention.

The operation of the control circuit can be further enhanced by the addition of another capacitance 4, as may be seen in the circuit of FIG. 4, or the capacitance 53 in FIG. 5. Such capacitor has a value, for example, of 20 to 100 times smaller than the value of the capacitance 1 in FIG. 4, or the capacitance 52 in FIG. 5. For example, in the circuit described above in FIG. 5 where the capacitance 52 is approximately 1 $\mu$F, the capacitance 53 may be 0.03 $\mu$F. This additional small capacitor 53 is placed in parallel with the series R-C network in the circuit of FIG. 5. This additional small capacitor 53 adds a high frequency pole to ensure continued loop gain roll-off at higher frequencies.

A similar circuit to those of FIGS. 1 and 5 can be used to sense and/or control power in a gas discharge lamp. In which case zero compensation for the power control loop would apply. To sense power the resistance would be placed in another location, for example, in series with one of the transistors 18.

The compensation method can also apply when other control methods, such as pulse width modulation, for example, are used for controlling lamp current or power levels.

What we claim:

1. Ballast stabilization circuitry for gas discharge tubes comprising:

(a) at least one low pressure gas discharge lamp, and (b) control circuit means for controlling current through said at least one gas discharge lamp, said control circuit means including:

feedback network means having a resistance value that introduces a zero in frequency response of said control circuit means and for eliminating oscillation to the lamp current envelope.

2. Ballast stabilization circuitry according to claim 1, wherein said resistance value is selected according to type of gas discharge lamp.

3. Ballast stabilization circuitry according to claim 1, wherein said resistance value is disposed in series combination with a first capacitance.

4. Ballast stabilization circuitry according to claim 3, wherein a second capacitance is disposed in parallel with said series combination of said resistance value and said first capacitance, said second capacitance being much smaller than said first capacitance.

5. Ballast stabilization circuitry for gas discharge tubes comprising:

(a) at least one low pressure gas discharge lamp, and (b) control circuit means for controlling current through said at least one gas discharge lamp, said control circuit means including:

feedback network means having a resistance value that introduces a zero in frequency response of said control circuit means for eliminating fluctuations in amplitude of high frequency current.

6. Ballast stabilization circuitry according to claim 5, wherein said resistance value is selected according to type of gas discharge lamp.

7. Ballast stabilization circuitry according to claim 5, wherein said resistance value is disposed in series combination with a first capacitance.

8. Ballast stabilization circuitry according to claim 7, wherein a second capacitance is disposed in parallel with said series combination of said resistance value and said first capacitance, said second capacitance being much smaller than said first capacitance.

9. A method for operating ballast stabilization circuitry comprising the steps of:

(a) adding a zero to the frequency response of current or power controlled feedback of a gas discharge lamp ballast, and (b) cancelling the effect of a pole introduced into loop transmission of the circuitry by lamp dynamics.

10. A method for operating ballast stabilization circuitry comprising the steps of:

(a) adding a zero to the frequency response of current or power controlled feedback of a fluorescent lamp ballast, and (b) cancelling the effect of a pole introduced into loop transmission of the circuitry by lamp dynamics.

* * * * *